United States Patent [19]

Wisebaker et al.

[11] 4,398,408

[45] Aug. 16, 1983

[54] FORGING MACHINE TRANSFER

[75] Inventors: Robert E. Wisebaker; Gaylen O. Kline, both of Tiffin, Ohio

[73] Assignee: The National Machinery Company, Tiffin, Ohio

[21] Appl. No.: 257,725

[22] Filed: Apr. 27, 1981

[51] Int. Cl.[3] ..... B21J 13/10

[52] U.S. Cl. ..... 72/422; 72/405; 10/12 T; 414/751

[58] Field of Search ..... 72/361, 405, 422; 269/224; 414/741, 751; 10/11 T, 12 T, 72 T, 76 T

[56] References Cited

U.S. PATENT DOCUMENTS

| | | | |
|---|---|---|---|
| 1,569,895 | 1/1926 | Svensson et al. | 10/11 T |
| 3,105,399 | 10/1963 | Strugala et al. | 72/405 |
| 3,488,784 | 1/1970 | Hatebur | 10/12 T |
| 3,512,391 | 5/1970 | Bozich | 72/405 |

*Primary Examiner*—Lowell A. Larson

*Attorney, Agent, or Firm*—Pearne, Gordon, Sessions, McCoy, Granger & Tilberry

[57] ABSTRACT

A transfer for hot forging machines or the like is disclosed. Such transfer includes a gripper support structure including a housing providing a longitudinal bore in which spaced cylindrical sleeve bearings are mounted. A gripper support provides the cylindrical portion journaled in the bearings for limited longitudinal movement. Mounted within an axial bore in the gripper support is a spring which resiliently urges the support in the direction of workpiece gripping. The support is provided with a longitudinal opening through which a key projects to prevent relative rotation between the housing and the support, and against which one end of the spring abuts. The housing provides substantially full enclosure of the working parts of the gripper to prevent damage by scale or the like.

7 Claims, 6 Drawing Figures

FORGING MACHINE TRANSFER

BACKGROUND OF INVENTION

This invention relates generally to transfers for forging machines or the like, and more particularly to a novel and improved gripper system for such transfers which is particularly suited for hot forging machines.

PRIOR ART

Forging machine transfers for automatically transferring workpieces from one work station to the next are well known. Examples of such transfers are described in U.S. Pat. Nos. 3,422,657; 3,965,718; and 4,186,589. Transfers for cold formers generally provide gripper mechanisms having relatively unprotected bearings and are satisfactory for cold forging where scale or the like is not encountered.

In hot forging machines, however, scale forms on the workpiece, and during the working operations, such scale tends to break off in the die area. Such scale is very abrasive and tends to produce excessive wear if it is allowed to reach the operating mechanisms of the transfer.

In order to protect the mechanisms from damage by scale or the like, transfers have been developed which remove substantial parts of the operating mechanism from the die area to a location in which scale cannot reach the mechanism. Examples of such transfers are described in the latter two U.S. Letters Patent cited above.

SUMMARY OF INVENTION

The present invention provides a novel and improved assembly particularly suited for hot formers. Such gripper assembly provides a simple structure for supporting a spring-biased gripper finger for limited movement and for protecting the various operating parts of the assembly from excessive wear or damage caused by foreign particles such as scale.

The assembly is illustrated in combination with a transfer as illustrated in U.S. Pat. No. 3,965,718, supra, assigned to the assignee of the present invention. Such transfer provides gripper supports at the end of a pair of bars which move toward and away from each other to grip and release a workpiece and move longitudinally to transfer gripped workpieces from one location to another. The operating mechanism is located in a shielded area to one side of the work area, where it is protected from scale or the like.

There are a number of aspects to the present invention. In accordance with one aspect of the invention, an elongated gripper support is mounted in spaced sleeve bearings mounted in a tubular housing. Relative rotation between the housing and gripper support is prevented by a key-type projection which also serves as a spring abutment. The sleeve bearings are easily replaced and are low in cost. Further, the housing fully encloses the mechanism, with only the lower bearing exposed. Therefore, scale or the like does not cause excessive wear.

In accordance with other aspects of this invention, a structurally simple finger support is provided which incorporates a single adjustment for ease of tooling setup. Further, the structure is light in weight so that it is capable of high speed operation.

In combination with the illustrated transfer system, the entire transfer is substantially immune to scale damage even when used on a hot forging machine.

These and other aspects of this invention will become more apparent in the following description and drawings.

DETAILED DESCRIPTION OF THE DRAWINGS

Figure 1:
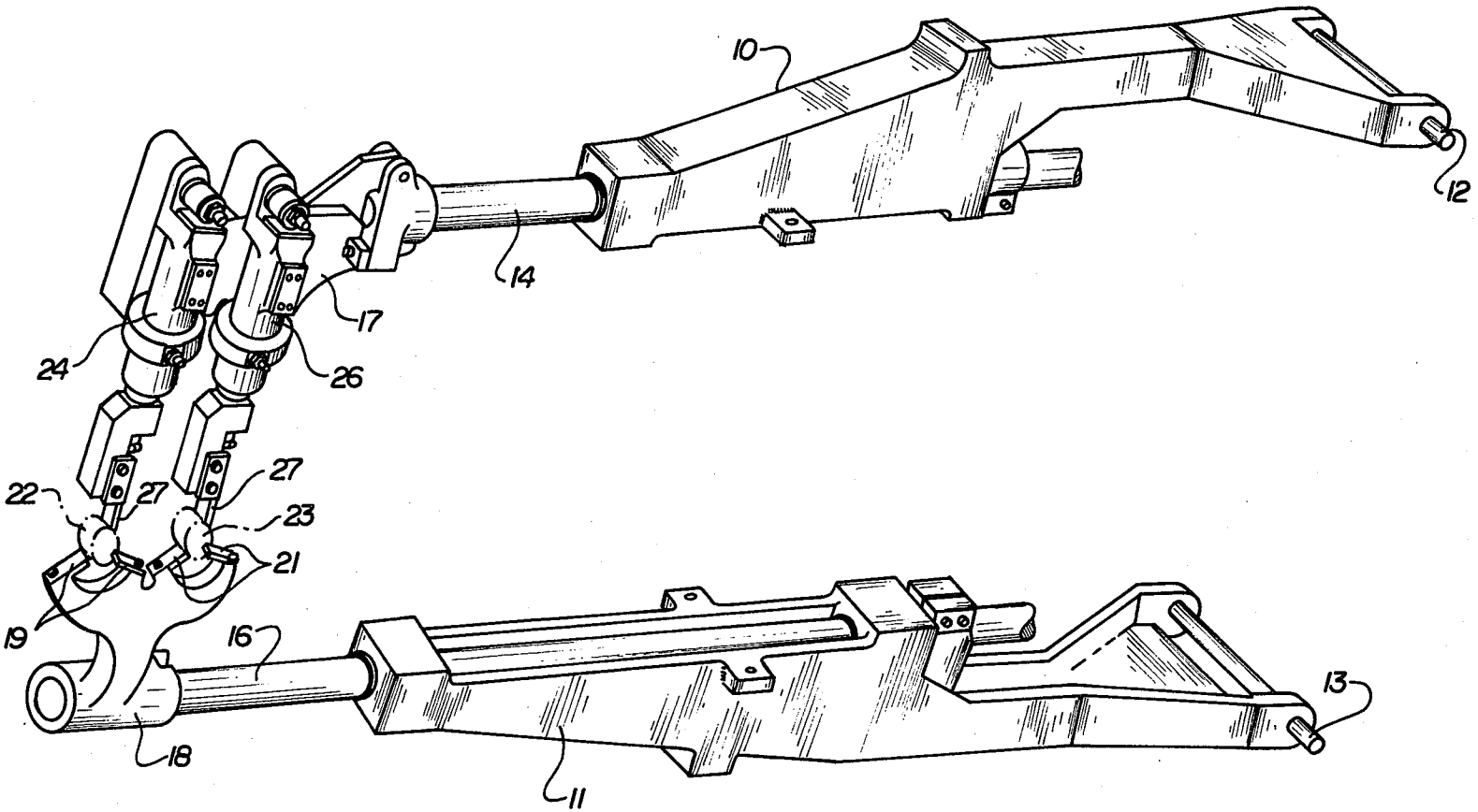
FIG. 1 is a fragmentary, perspective view of a transfer system in accordance with the present invention.

FIG. 1 is a fragmentary view of a transfer in accordance with the present invention. Such transfer includes a pair of support members 10 and 11, respectively pivoted for limited oscillating movement on pivot shafts 12 and 13. A cylindrical transfer arm 14 is journaled for longitudinal movement relative to the support 10 and an opposed cylindrical arm 16 is journaled for longitudinal movement on the support 11.

Figure 5:
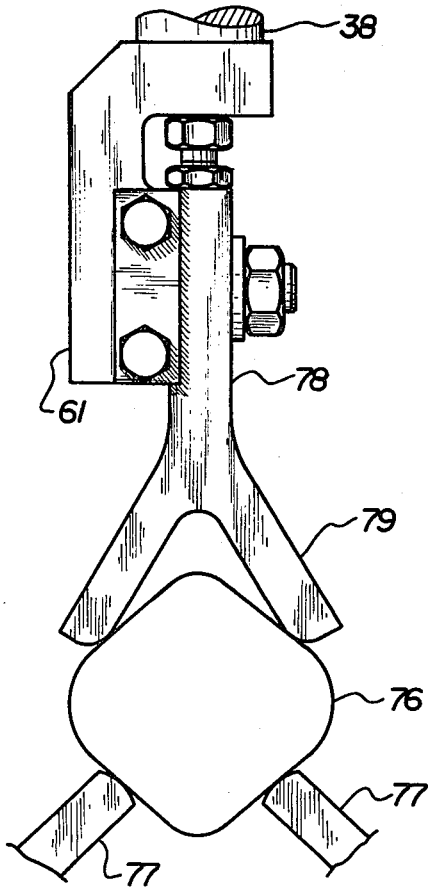
FIG. 5 is a fragmentary view of a first modified gripper finger which may be used with the gripper assembly.

The support structure, including the supports 10 and 11 and the arms 14 and 16, are disclosed and described in detail, along with the drive mechanism, in FIG. 5 and the related specification of U.S. Pat. No. 3,965,718, supra, and reference should be made to such patent for such disclosure. Further, such patent is incorporated herein by reference in its entirety to provide additional background for this invention, and in particular to describe the structural detail of the basic transfer and its operating mechanism.

A mechanism is provided to prevent rotation of the two arms 14 and 16 relative to their supports 10 and 11 about their respective axes. Further, a drive is provided for pivoting the two supports 10 and 11 in an oscillating manner about their respective axes 12 and 13 between the gripping position illustrated, in which the two arms 14 and 16 are parallel, and a release position in which the two arms 14 and 16 diverge and cause release of the workpiece. Similarly, a power drive is provided to extend and retract the two arms 14 and 16.

In operation, the drives are arranged to pivot the two supports 10 and 11 toward each other when the arms 14 and 16 are in a position for gripping workpieces so as to cause the gripper system described in detail below to grip one or more workpieces. When the arms 14 and 16 reach a parallel relationship illustrated, the workpieces are gripped.

While the supports 10 and 11 continue to maintain the arms 14 and 16 in substantially parallel relationship so that the workpieces remain gripped, the arms 14 and 16 move longitudinally to transport the gripped workpieces to a release position. When the workpieces are moved to a release position, the powering mechanism operates to move the two supports 10 and 11 with pivotal movement away from each other to cause the two arms 14 and 16 to move apart and cause release of the workpiece. Thereafter, while the arms are maintained in a spread or diverging condition, they are moved longitudinally back to the pick-up position for subsequent gripping operations.

Mounted on the ends of the two arms 14 and 16, respectively, are gripper supports 17 and 18. In the illustrated embodiment, two pairs of fixed grippers 19 and 21 are mounted on the gripper support 18, which is the lower of the two gripper supports, so that two separate workpieces 22 and 23 may be gripped and transferred during a given transfer operation. Associated with the pair of fixed gripper fingers 19 is a first gripper assembly 24 and associated with the pair of grippers 21 is a second gripper assembly 26. Each of the gripper assemblies 24 and 26 has the same structure, so the subsequent description of one of them applies equally to both.

In the embodiment of FIG. 1, a single spring-biased gripper finger 27 cooperates with the pair of fixed fingers 19 to grip the workpiece 22 and a similar single finger 27 on the gripper assembly 26 cooperates with the pair of gripper fingers 21 to grip a workpiece 23.

Figure 2:
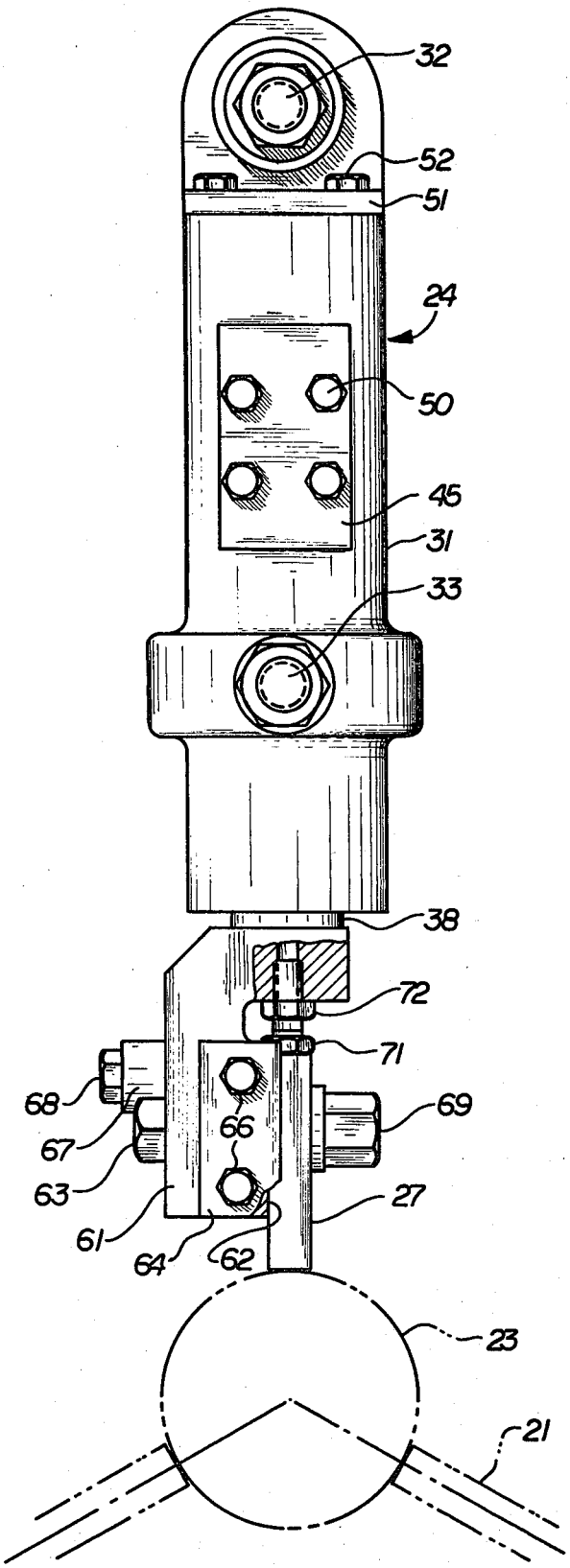
FIG. 2 is a front elevation of the gripper assembly incorporating the present invention.
Figure 3:
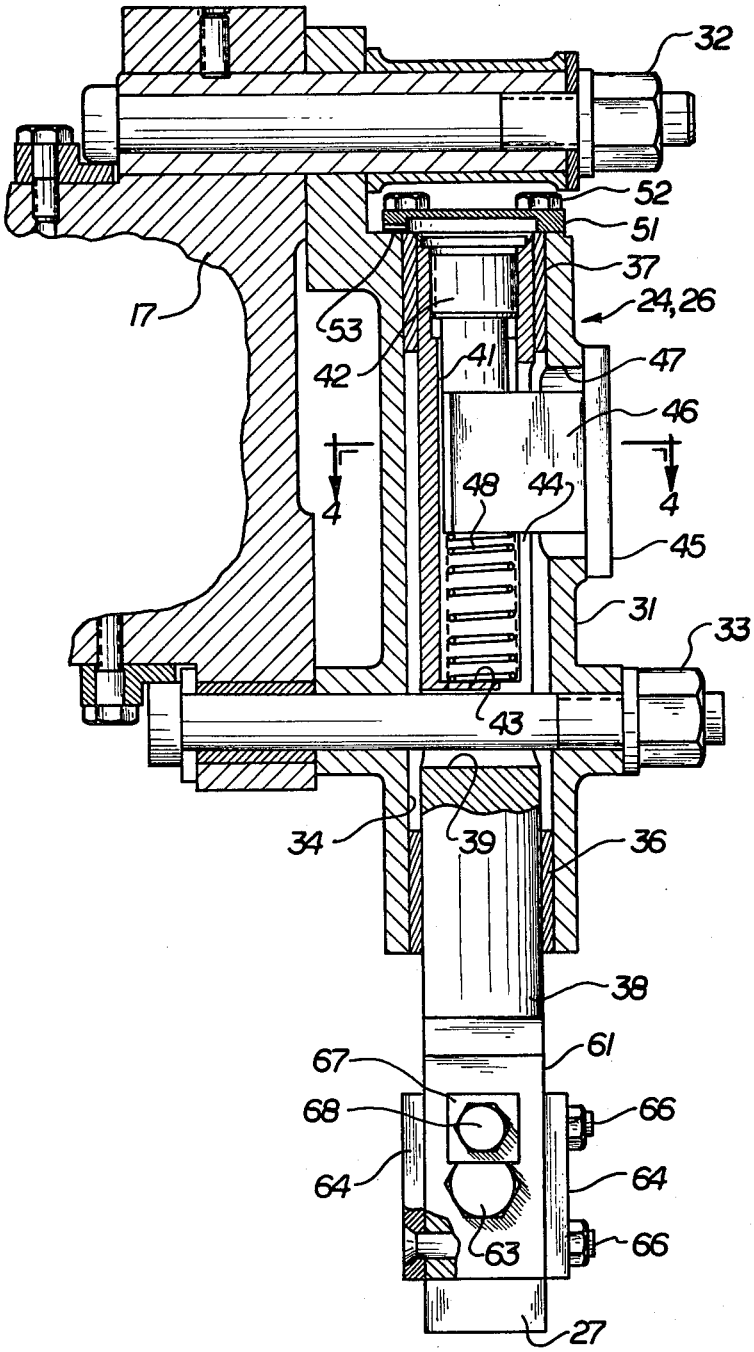
FIG. 3 is a side elevation of the gripper assembly partially in longitudinal section.
Figure 4:
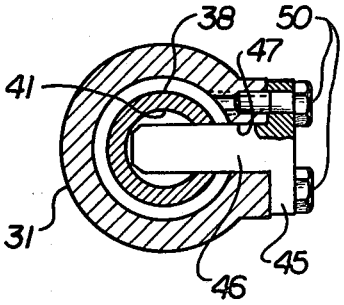
FIG. 4 is a fragmentary section taken along line 4—4 of FIG. 3.

Referring now to FIGS. 2 through 4, each gripper assembly includes a tubular housing 31 secured by bolts 32 and 33 to the upper support 17. The housing is provided with a central cylindrical bore 34 having a lower sleeve bearing 36 mounted at its lower end and an upper sleeve bearing 37 mounted at its upper end. Journaled for longitudinal movement within the two space bearings 36 and 37 is an elongated, generally cylindrical finger support 38. Such support 38 is provided with an elongated lateral opening 39 through which the bolt 33 extends with clearance, and which is elongated a sufficient amount to allow the required longitudinal movement of the support 38.

Extending from the upper end of the support 38 is an axial bore 41 which is threaded at its upper end to receive a stop plug 42 and extends to a bottom wall 43. A longitudinal slot 44 extends along and through one wall of the support 38 and is proportioned to receive the inner end of a key 46 to prevent relative rotation between the support 38 and the housing 31. Such key 46 is provided with a flange 45 which is proportional to fit over a lateral opening 47 in the housing 31 and its removably secured in place by bolts 50 (illustrated in FIGS. 2 and 4).

A compression spring 48 extends between the lower side of the key 46 and the end wall 43, and resiliently biases the support 38 in a downward direction, normally maintaining the stop plug 42 in engagement with the upper side of the key. Thus, the stop plug 42 functions with the key 46 to limit the downward movement of the support 38 and determines the extended position thereof. When a workpiece is gripped by the gripper assembly, a small amount of movement of the support 38 relative to the housing 31 occurs against the action of the spring 48. The spring 48 accommodates for variations in the size of the workpiece and ensures that gripping with a force determined by the spring 48 exists.

A cover plate 51 is removably secured by bolts 52 to close the upper end of the central bore 41, and is provided with a central recess sized to accommodate limited upward movement of the stop plug 42. A small vent opening 53 is provided in the cover 51 to allow the mechanism to breathe. However, this vent opening is preferably located at the rearward side of the cover 51 in a protected location so that scale or other foreign matter cannot enter the interior of the housing.

The mounting for the gripper finger per se is best illustrated in FIGS. 2 and 3. The lower end of the support 38 is formed with an offset, axially extending mounting portion 61 having a forward face 62 against which the finger 27 is mounted by a bolt 63. Side plates 64 mounted on opposite sides of the offset portion 61 by bolts 66 extend past the face 62 to provide lateral positioning of the finger 27. Preferably, the width of the finger 27 is such that the two plates 64 closely fit the sides of the finger when the bolts 66 are tightened. A retainer clip 67 secured to the offset portion 61 by a bolt 68 overlies the head of the bolt 63 to retain it in position and prevent rotation when the nut 69 on the bolt 68 is tightened or loosened.

A finger adjusting bolt 71 is threaded into the lower end of the support 38 and is provided with a lock nut 72 to lock it in an adjusted position. The adjustment of the positioning of the finger 27 is accomplished by loosening the nut 69 and appropriately adjusting the bolt 71 until the finger is properly positioned. An elongated slot (not illustrated) is provided in the finger 27 through which the bolt 63 projects to allow limited longitudinal adjustment of the finger relative to the support. After the proper position of the finger is achieved by adjustment of the bolt 71, it is a simple matter to lock the parts in position by tightening the nut 69.

FIG. 5 illustrates another form of finger which may be used in some instances for gripping shaped parts, such as the workpiece 76, which is noncircular. In such instance, the location of the fixed fingers 77 may be appropriately changed for proper gripping of the workpiece 76, as illustrated. A gripper finger 78 is mounted on the offset portion 61 of the support 38 in the usual manner. However, the finger 78 is provided with a Y-shaped lower end at 79 so that the workpiece is gripped at four locations, as illustrated. Here again, the gripping force is determined by the spring 48.

Figure 6:
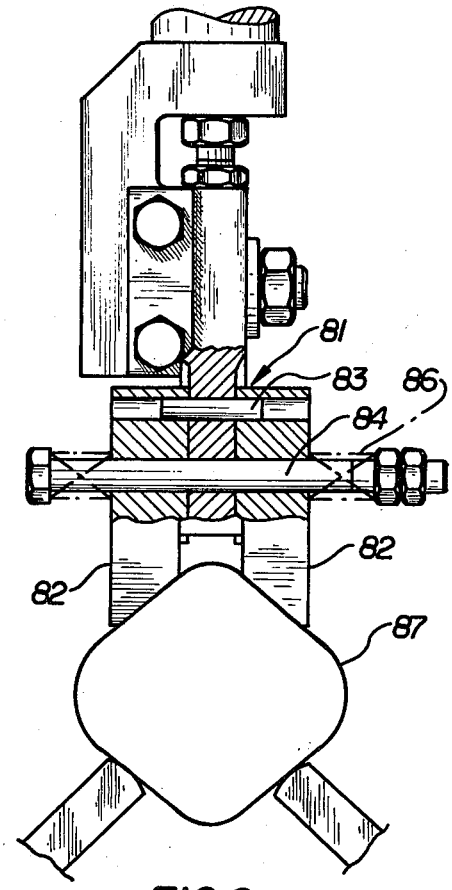
FIG. 6 is a fragmentary view similar to FIG. 5, but illustrating a second modified gripper structure.

FIG. 6 discloses another modified form of gripper finger which may be used in some instances. In this modified form, a finger assembly 81 is provided with a pair of movable jaws 82 which are located by a pin 83 and a bolt 84. A spring 86 on the bolt resiliently urges the fingers 81 toward each other, but allows limited separating movement when a workpiece is gripped. This finger assembly 81 is mounted and adjusted on the support 38 in the same manner as the prior forms of grippers, but is provided with limited spring action to better ensure uniform gripping at four locations on the workpiece 87. If variations in the tolerances of the workpiece are significant, this form of gripper ensures that full gripping will be accomplished at four locations. Here again, however, the principal gripping force is provided by the spring 48 in the gripper assembly.

In each of the embodiments, the principal mechanism of the gripper assembly is enclosed within the housing 31 so that it cannot be damaged by scale. The only relative movement between parts which are exposed to scale in the embodiments of FIGS. 2 and 5 exists between the support 38 and the lower edge of the bearing 36. Because of the position of these parts, there is little tendency for scale to accumulate which could produce wear, and excessive wear does not present a problem. In the embodiment of FIG. 6, it is recognized that limited relative movement can occur between the various elements of the finger assembly itself; however, even in this embodiment, the principal finger structure is not exposed to damage by scale or the like.

If it becomes necessary to replace either of the bearings 36 or 37, this can be accomplished by disassembly and the replacement costs of the bearings is low. Further, the mass of the finger portion which is biased by the spring 48 is relatively low, so proper gripping can be accomplished without the use of heavy springs. It is recognized that the embodiments of FIGS. 5 and 6 provide a slightly larger mass in the finger system, but such increase in mass is not excessive.

In most instances, the structure can be quickly and easily adjusted during the set-up of the tooling. Since the adjustment is on the finger mounting itself, it is not necessary to adjust the principal structure of the gripper assembly.

Although the gripper assembly is illustrated in combination with a particular transfer mechanism, in its broader aspects it may be applied to other transfer systems; and in its broader aspects this invention is not limited to such combination.

Although the preferred embodiments of this invention have been shown and described, it should be understood that various modifications and rearrangements of parts may be resorted to without departing from the scope of the invention as disclosed and claimed herein.

What is claimed is:

1. A transfer gripper for forging machines or the like comprising a housing, an elongated gripper support having a generally cylindrical portion extending into said housing, bearings supporting said gripper support for longitudinal movement relative to said housing, guide means preventing longitudinal rotation therebetween, spring means urging said gripper support longitudinally in one direction and resisting movement in the opposite direction, a first gripper mounted on said gripper support, a second opposed gripper, said housing being movable in a first direction toward said second opposed gripper and in an opposite direction away therefrom, said first gripper operating in cooperation with said second gripper to grip a workpiece with a force provided by said spring means for transferring said workpiece from a first location to a second location in response to movement of said housing in said first direction and to release said workpiece in response to movement of said housing in said opposite direction, said housing enclosing said bearing means and said spring means to prevent scale or the like from interfering with the operation thereof.

2. A transfer as set forth in claim 1, wherein said bearing means includes a pair of spaced cylindrical slide bearings mounted in said housing, and said gripper support provides cylindrical mating portions journaled in said bearings for longitudinal movement relative to said housing, said guide means providing longitudinal opposed surfaces on said housing and said gripper support preventing relative rotation therebetween.

3. A transfer as set forth in claim 2, wherein said gripper support provides a gripper mounting portion, and an adjustable stop is provided on said mounting portion to adjustably limit movement of said first gripper in said opposite direction.

4. A transfer as set forth in claim 3, wherein said adjustable stop is accessible for easy adjustment and lock means are provided to lock said first gripper against said adjustable stop.

5. A transfer as set forth in claim 4, wherein all parts of said gripper support and said first gripper are locked against relative movement during operation of said transfer.

6. A transfer as set forth in claim 1, wherein all parts of said gripper support and said first gripper are locked against relative movement during operation of said transfer.

7. A transfer for hot forging machines or the like comprising:

powered first and second opposed carriers movable in one direction toward and away from each other for gripping and releasing workpieces and movable in a direction perpendicular thereto for transferring workpieces from one location to another location, first and second gripper means respectively mounted on said first and second carriers cooperating to grip and release workpieces in response to movement of said carriers toward and away from each other in said one direction, said first gripper means including a housing mounted on one carrier provided with a first bore therein, a pair of spaced cylindrical bearings in said first bore, an elongated gripper support extending into said first bore and journaled in said bearings for longitudinal movement relative to said housing in said one direction, a second bore in said gripper support and a longitudinal slot open to said second bore, a projection removably mounted on said housing extending through said slot into said second bore preventing relative rotation between said gripper support and said housing, a spring in said second bore engaging said projection and said support resiliently biasing said gripper support in said one direction towards said second gripper means, a stop on said gripper support engageable with the side of said projection opposite said spring limiting movement of said gripper support relative to said housing towards said second gripper means, and a gripper finger carried by said gripper support on the end thereof, said housing enclosing said bearings, springs, and projection to prevent scale or the like from interfering with the operation thereof.

* * * * *